US006540174B1

(12) United States Patent
Jarvinen

(10) Patent No.: US 6,540,174 B1
(45) Date of Patent: Apr. 1, 2003

(54) PAPERBOARD CORE WITH AN IMPROVED CHUCK STRENGTH, FOR THE PAPER INDUSTRY, AND A METHOD OF FABRICATING SUCH

(75) Inventor: Markku Jarvinen, Huutjärvi (FI)

(73) Assignee: Ahlstrom Cores Oy, Karhula (FI)

( * ) Notice: Subject to any disclaimer, the term of this patent is extended or adjusted under 35 U.S.C. 154(b) by 0 days.

(21) Appl. No.: 09/582,994

(22) PCT Filed: Jan. 22, 1999

(86) PCT No.: PCT/FI99/00043

§ 371 (c)(1),
(2), (4) Date: Jul. 10, 2000

(87) PCT Pub. No.: WO99/39902

PCT Pub. Date: Aug. 12, 1999

(30) Foreign Application Priority Data

Jan. 23, 1998 (FI) ..... 980145

(51) Int. Cl.[7] ..... B65H 75/14

(52) U.S. Cl. ..... 242/610.1; 242/118.8; 493/299; 138/144; 428/34.2

(58) Field of Search ..... 242/610.1, 118.8; 493/299; 138/144; 428/34.2

(56) References Cited

U.S. PATENT DOCUMENTS

| | | | |
|---|---|---|---|
| 3,194,275 A | 7/1965 | Biggs, Jr. et al. | |
| 4,942,769 A | 7/1990 | Järvinen et al. | 73/82.1 |
| 5,167,994 A | 12/1992 | Paulson | |
| 5,379,648 A | 1/1995 | Tiffin | 73/847 |
| 5,472,154 A | 12/1995 | Qiu et al. | |
| 5,505,395 A | 4/1996 | Qiu et al. | |

FOREIGN PATENT DOCUMENTS

| | | |
|---|---|---|
| EP | 0 309 123 B1 | 7/1993 |
| EP | 0 627 306 A1 | 12/1994 |
| WO | WO 98/35825 | 8/1998 |

*Primary Examiner*—John Q. Nguyen
(74) *Attorney, Agent, or Firm*—Nixon & Vanderhye P.C.

(57) ABSTRACT

A method of fabricating paperboard cores, and the paperboard cores so fabricated, have improved chuck strength and can be used with chucks rotating at a speed of at least 200 mm/min., even with paper rolls having a weight of over 8.5 tons. A plurality of paperboard plies (e.g. made by press drying) are wound spirally around a mandrel into a tube to produce a paperboard core having a cylindrical surface and inside diameter and a wall thickness of 10 mm or more. The method is practiced so as to fulfill the following conditions: (1) the inside diameter of the paperboard core being 73 mm to 110 mm, $L_{mp}$<1550 mm, preferably less than 1450 mm, and more preferably less than 1300 mm; with the inside diameter of the paperboard core being 111 mm to 144 mm, $L_{mp}$<1900 mm, preferably less than 1650 mm, and more preferably less than 1500 mm; with the inside diameter of the paperboard core being 145 to 180 mm, $L_{mp}$<2450 mm, preferably 2200 to 1500 mm, and more preferably less than 1500 mm; and with (4 the inside diameter of the paperboard core being 181 mm to 310 mm, $L_{mp}$4500 mm, preferably less than 3900 mm, and more preferably 3900 mm to 2000 mm, where $L_{mp}$ is the web edge length of the paperboard ply on the cylindrical surface representing the z-direction stress maximum in the wall of a paperboard core per 1 linear meter of the paperboard core.

23 Claims, 6 Drawing Sheets

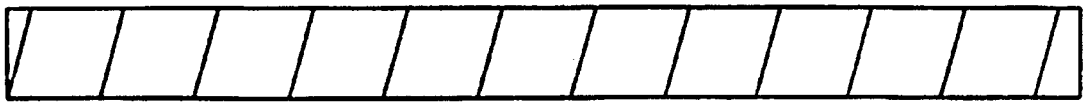
FIG. 1 a Typical 150 mm core
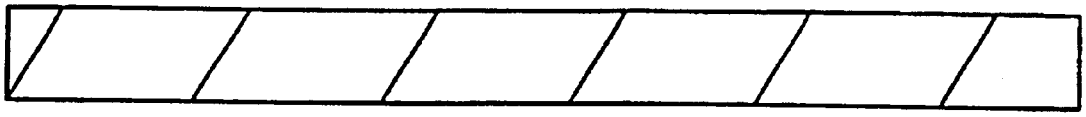
FIG. 1 b Typical 76 mm core
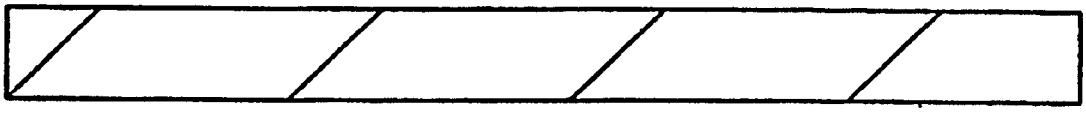
FIG. 1 c New construction
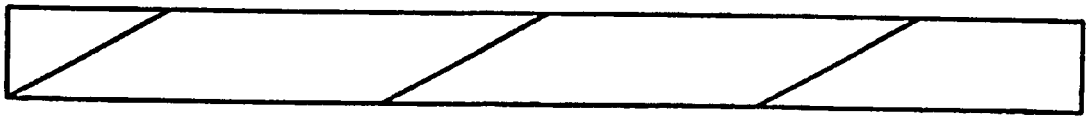
FIG. 1 d New construction

| $t$ | $sv_t$ | $\phi_t$ | $S_t$ | $elength_t$ |
|---|---|---|---|---|
| 1 | 0.53 | 151.06 | 152.868 | 3104.441 |
| 2 | 1.06 | 152.12 | 152.978 | 3123.972 |
| 3 | 1.59 | 153.18 | 153.086 | 3143.516 |
| 4 | 2.12 | 154.24 | 153.192 | 3163.075 |
| 5 | 2.65 | 155.3 | 153.297 | 3182.647 |
| 6 | 3.18 | 156.36 | 153.399 | 3202.232 |
| 7 | 3.71 | 157.42 | 153.5 | 3221.83 |
| 8 | 4.24 | 158.48 | 153.598 | 3241.441 |
| 9 | 4.77 | 159.54 | 153.695 | 3261.064 |
| 10 | 5.3 | 160.6 | 153.79 | 3280.7 |
| 11 | 5.83 | 161.66 | 153.884 | 3300.347 |
| 12 | 6.36 | 162.72 | 153.976 | 3320.007 |
| 13 | 6.89 | 163.78 | 154.066 | 3339.678 |
| 14 | 7.42 | 164.84 | 154.154 | 3359.36 |
| 15 | 7.95 | 165.9 | 154.241 | 3379.054 |
| 16 | 8.48 | 166.96 | 154.327 | 3398.758 |
| 17 | 9.01 | 168.02 | 154.411 | 3418.474 |
| 18 | 9.54 | 169.08 | 154.494 | 3438.2 |
| 19 | 10.07 | 170.14 | 154.575 | 3457.937 |
| 20 | 10.6 | 171.2 | 154.655 | 3477.684 |
| 21 | 11.13 | 172.26 | 154.733 | 3497.441 |
| 22 | 11.66 | 173.32 | 154.811 | 3517.208 |
| 23 | 12.19 | 174.38 | 154.886 | 3536.984 |
| 24 | 12.72 | 175.44 | 154.961 | 3556.771 |
| 25 | 13.25 | 176.5 | 155.034 | 3576.567 |

TAB. 1

PAPERBOARD CORE WITH AN IMPROVED CHUCK STRENGTH, FOR THE PAPER INDUSTRY, AND A METHOD OF FABRICATING SUCH

CROSS-REFERENCE TO RELATED APPLICATION

This application is a U.S. national phase of International Application PCT/F199/00043 filed Jan. 22, 1999.

BACKGROUND AND SUMMARY OF THE INVENTION

The present invention relates to a method of fabricating paperboard cores for the paper industry, said paperboard cores having an improved chuck strength and thick walls, the wall thickness H being 10 mm or more and the inside diameter over 70 mm. Such cores are used at winding/unwinding speeds of at least about 200 m/min (3.3 m/s). The invention also relates to a method of fabricating other paperboard cores of similar dimensions, which call for high chuck strength. The invention further relates to a spirally wound, thick-walled core constructed by this method.

Cores used by the printing and paper converting industries are herein referred to as paper industry cores. Such cores are thick-walled, having a wall thickness H which is at least 10 mm and an inside diameter which is over 70 mm.

A spiral paperboard core is made up of a plurality of superimposed plies of paperboard by winding, glueing, and drying such.

Webs produced in the paper, film, and textile industries are usually reeled on cores for rolls. Cores made from paperboard, especially spiral cores are fabricated by glueing plies of paperboard one on top of the other and by winding them spirally in a special spiral machine. The width, thickness, and number of paperboard plies needed to form a core vary depending on the dimensions and strength requirements of the core to be manufactured. Typically, the ply width is 50 to 250 mm (in special cases about 500 mm), ply thickness about 0.2 to 1.2 mm, and the number of plies about 3 to 30 (in special cases about 50). The strength of a paperboard ply varies to comply with the strength requirement of the core. As a general rule, increasing the strength of a paperboard ply also increases its price. Generally speaking, it is therefore true to say that the stronger the core, the more expensive it is.

In the paper converting industry, weights of paper rolls used, e.g., in printing presses have been on a continuous increase, which calls for a higher and higher strength and a higher and higher capacity of spiral cores. The weights of paper rolls vary considerably, from newspaper and fine paper rolls of 600–1800 kg to rotogravure rolls of about 2400–5500 kg. The biggest rolls that have been made, for testing purposes, have weighed about 6500 kg. The diameters of big paper rolls are then typically 1.24 to 1.26 m at most.

Printing presses typically use cores of two sizes. The most usual core size has the inside diameter of 76 mm (3") and the wall thickness of 13 or 15 mm. Today, the widest and fastest printing presses, i.e., those with the heaviest rolls, use cores with the inside diameter of 150 mm (6") and normally the wall thickness of 13 mm.

Printing presses are being designed which should handle paper rolls having a diameter of 1.35 m; estimates have been presented of even 1.5 m rolls. As the roll width increases to 3.6 m, the weight of a paper roll will increase considerably, to more than 6.5 tons, even to 8.5 tons.

Typical ply widths of paperboard cores used in the printing and paper converting industries, as discussed above, are about 120 to 150 mm with cores having the inside diameter of 76 mm (3"), which is the most commonly used inside diameter, and up to 190 mm with cores having the inside diameter of 150 mm (6"). Due to core geometry, average winding angles a then range from about 15 to about 35°, depending on the core diameter. The wall thicknesses of paperboard cores are typically about 10 to 20 mm. The definition of the average winding angle $\alpha$ is presented in FIG. 3 below.

Paper reels are formed on a winding core. Almost always this winding core is a spirally wound paperboard core.

The requirement of a good chuck strength is emphasized especially in, e.g., shaftless winding/unwinding of a paper web, where the core, serving as the only shaft, bears the weight of the paper roll either partly or completely through short chucks of about 50 to 250 mm in length. Furthermore, the chuck may be subject to a pressure of accelerating belts needed for an automatic reel change in the printing press. These accelerating belts may cause an extra strain of even 1 to 2 tons on the core.

The chuck strength is an essential requirement at the paper mill in making the roll, when slitter winders of the so-called centre winder type are used.

In shaftless winding and unwinding, the weight of a paper roll creates stresses in the core, at chucks. The most dangerous of them are shear stresses and radial stresses.

When paper rolls equal in weight are supported, these stresses become different as to their form and extent, depending on the wall strength and inside diameter of the core. The form of stresses at different points inside the core wall as well as the point where the maximum stresses occur, may be calculated, and it may also be found experimentally, e.g., by using a method and apparatus in accordance with European patent 309 123.

As discussed above, cores are subject to different stresses when they are used, e.g., in a paper roll. In shaftless winding/unwinding, the core serves as the only shaft, supporting the weight of the paper roll either entirely or partly, through a short chuck. The pressure caused by accelerating belts, needed for automatic reel change at printing presses, possibly adds to the weight.

In this kind of a situation, the core becomes subject to several stresses, which strain the core and may cause its breakage. As a paperboard core is an orthotropic material, knowing these stresses is a highly exacting task.

By using advanced modelling methods known to a person skilled in the art, shear, compressive or flat crush, and tensile stresses may be analysed so as to find out where different stresses appear, and also, at which depth in the core wall there are stresses in actual use and how heavy they are. The results of the analysis may be confirmed experimentally, e.g., by using a method and apparatus in accordance with EP patent 309 123. By using the test method in accordance with EP 309 123, it is possible to simulate stresses of a core in use conditions. These stresses, appearing in use conditions, may also be modelled by means of computationally demanding finite-element methods. We have made stress analyses of chuck loading, which have indicated and experimental testing (by using an apparatus according to EP 309 123) confirmed that the heaviest z-direction stresses appear almost in the middle of core wall, slightly towards the inner surface of the core. The z-direction here means a direction perpendicular to the surface level of a paperboard ply, i.e., in the cross section of a finished core, it is the direction of the core radius.

The z-direction maximum tensile and shear stresses directed to the plies are radial, occurring near the middle of the core wall, slightly inwardly therefrom.

We have described the problematic area which our invention originates from. A review of prior art revealed U.S. Pat. No. 3,194,275. The problems treated there are, however, totally different and the solution provided is completely different from ours. U.S. Pat. No. 3,194,275 will be discussed further below, in connection with the more detailed description of the present invention. The comparison between the present invention and the arrangement disclosed in U.S. Pat. No. 3,194,275 indicates that the problems and, consequently, their solutions are different from each other.

An object of the present invention is to provide an improved and more efficient method of fabricating thick-walled paperboard cores for the paper industry, the wall thickness being over 10 mm and the inside diameter over 70 mm.

Another object of the present invention is to provide an improved method of increasing the chuck strength of both thick-walled paperboard cores for the paper industry, which have the wall thickness of over 10 mm and inside diameter of over 70 mm, and other paperboard cores which require high chuck strength, and at the same time to provide a novel type of thick-walled spiral paperboard core which has better properties in use.

A further object of the present invention is to solve problems related to the above discussed thick-walled spiral cores presently in use and to offer a solution for meeting the requirements set by ever increasing roll weights, especially on the chuck strength of cores.

These objects are achievable by the arrangement in accordance with the accompanying claims.

As discussed above, typical wall thickness—inside diameter figures are, e.g., 15 mm×76 mm and 13 mm×150 mm. Stresses caused by chuck loading on the biggest cores, such as, e.g., 13 mm×300 mm (10 mm×300 mm) are naturally lower than on paper industry cores having a smaller diameter, due to the core geometry. Thus, the chuck strength of, for example, 13×300 mm core is in itself higher than the chuck strength of cores having a small diameter. This is because, due to a big inside diameter, the bearing area of the core with respect to the shaft is large. The present invention does not relate to paperboard cores which have a wall thickness less than 10 mm. Paper industry cores must have a thick wall, i.e., more than 10 mm in order to enable them to be clamped by chucks (chuck expansion) and in order to enable formation of a nip between the core surface and a backing roll. Especially, the geometry of winders and slitter-winders calls for a sufficient wall thickness of cores, 10 mm or more, in practice. The arrangement of the present invention increases the production rate of all paper industry cores with different diameters, but its advantages as to the increase of chuck strength is pronounced with paper industry cores of small diameters. The greatest significance of an improved chuck strength is established in connection with most commonly used cores which have the inside diameter of 3" (about 76 mm). A significant improvement of the chuck strength is achieved also with cores having the inside diameter of 6" (about 150 mm).

The arrangement according to the present invention is also applicable to the fabrication of other paperboard cores, which require high chuck strength and which have similar dimensions as the cores according to the present invention, used in the printing and paper converting industries.

The present invention deals with core breaking, caused by a crack breaking mechanism. When breakages in cores occur in the paper industry, this is the most frequent mechanism, in practice. Here, the break of a core occurs in the cylindrical surface within the core wall and/or in the vicinity thereof, in which cylindrical surface the maximum stresses are to be found. Therefore, we have presented the widths and web edge lengths of the core ply on the level of the cylindrical surface and in the vicinity thereof, as attributes describing our invention. In principle, corresponding definitions could be made with respect to the interior or exterior plies, the dimensions of which are determined by selecting the structural dimensions of the core and by fixing, on the maximum stress surface, the ply length per linear meter of core or the ply width.

It is therefore an essential object, according to the present invention, that especially on the cylindrical surface representing the maximum stress in the wall direction of the cross section, i.e., z-direction of the core, but also elsewhere in the core wall, there are as few potential points for initial cracks as possible, which would lead to a breakage. By influencing potential points of initial cracks, i.e., by reducing their number, it is possible to influence particularly the chuck strength (delamination strength) of the core, i.e., to increase it.

The arrangement according to the invention, for improving the chuck strength of thick-walled paperboard cores for the paper industry, makes use of, e.g., the following discoveries.

With narrow plies, only a small pitch is formed per linear meter of the core, whereby there are several gaps between the plies per length unit of the core. Widening of the paperboard ply reduces the length of gaps per linear meter of the core.

The basic idea of our invention is to reduce the length of the gaps per linear meter of the core, thereby providing a paper industry core, which has less than before of web edge line of ply per linear meter, i.e., fewer potential points of initial cracks per linear meter of the core than before.

DESCRIPTION OF THE DRAWING

The method according to the invention of improving the chuck strength of paperboard cores for the paper industry and a thick-walled spiral core constructed by this method are described in further detail below, with reference to the accompanying drawings, in which FIG. 1*a* is a schematic side view of a prior art core having an inside diameter of 150 mm, FIG. 1*b* is a schematic side view of a second, commonly used prior art core having an inside diameter of 76 mm, FIG. 1*c* is a schematic side view of a core according to the present invention, FIG. 1*d* is a schematic side view of a second core according to the present invention, Table 1 shows a theoretical fabricating recipe of a prior art core of 13 mm×150 mm.

DETAILED DESCRIPTION OF THE DRAWINGS

Figure 2:
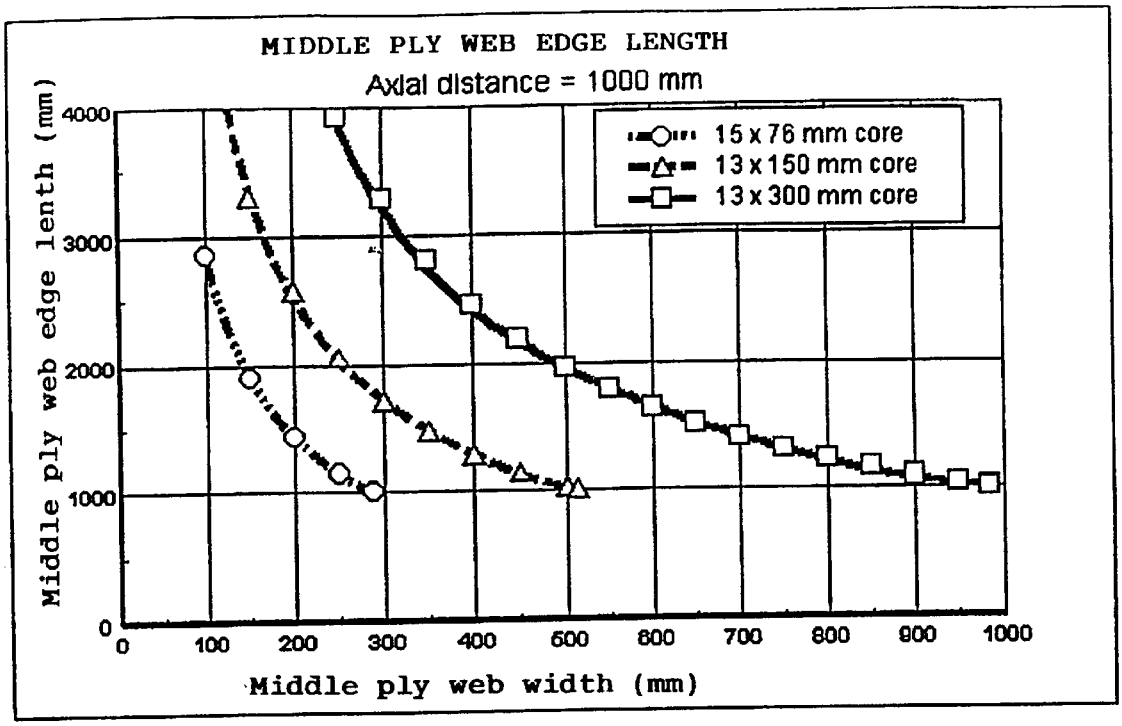
FIG. 2 shows the middle ply web edge length in a 1 m long core as a function of the middle ply width.

The idea of the present invention is to provide a structure for a thick-walled paper industry core, which is suitable for exacting chuck load conditions and which has a shorter length of gaps per linear meter of the core than prior art arrangements of paper industry cores. This is brought about by growing the width of the paperboard plies used in the core fabrication. When the number of gaps, i.e., the number of potential points for initial cracks is reduced per length unit, on the basis of the above discovery, this will result in a growth of core capacity, in other words, the chuck strength and load bearing capacity. Thus, in accordance with the present invention, wider plies than before are used in a core having a certain inside diameter. The inside diameter and the wall thickness of a core again influence the width gradation of the plies to be used.

FIG. 1*a* is a schematic side view of a prior art 13 mm×150 mm core. The middle ply web edge length per core meter is about 3340 mm in this core when the ply width is about 154 mm. FIG. 1*b* is a schematic side view of a second, commonly used prior art 15 mm×76 mm core. The middle ply web edge length per meter of this core is about 1914 mm when the ply width is about 150 mm. FIG. 1*c* is a schematic side view of a 13 mm×150 mm core in accordance with the present invention. The middle ply web edge length per meter of this core is about 1410 mm when the ply width is about 364 mm. If a 15 mm×76 mm core in accordance with the present invention is used, the middle ply web edge length of about 1410 mm corresponds to about 203 mm wide middle ply. FIG. 1*d* is a schematic side view of a second 13 mm×150 mm core in accordance with the present invention. The middle ply web edge length per meter of this core is about 1154 mm when the ply width is about 445 mm. If a 15 mm×76 mm core in accordance with the present invention is used, the middle ply web edge length of about 1152 mm corresponds to about 249 mm wide middle ply.

Paper industry cores of different inside diameters are characterized in the accompanying claims using the reference values characteristic of each core size. We have observed that good results are obtained, as to the increase of the chuck strength and core production rate, when all relevant things are considered, e.g., when a spiral paperboard core is fabricated by winding paperboard plies spirally around a mandrel into a tube, whereby the following applies on the cylindrical surface representing the stress maximum in the thickness direction of the wall of a finished paperboard core, and in the vicinity of said cylindrical surface, including the paperboard ply in the middle of the wall, per 1 linear meter of the paperboard core which has the inside diameter of 73 to 110 mm:

$L_{mp}$<1550 mm, preferably less than 1450 mm, and more preferably less than 1300 mm, which has the inside diameter of 111 to 144 mm:

$L_{mp}$<1900 mm, preferably less than 1650 mm, and more preferably less than 1500 mm, and which has the inside diameter of 145 to 180 mm:

$L_{mp}$<2450 mm, preferably 2200 to 1500 mm, and more preferably less than 1500 mm, where $L_{mp}$ is the web edge length of the paperboard ply on the cylindrical surface representing the z-direction stress maximum within the paperboard core wall, per 1 linear meter of the paperboard core.

Also, when the inside diameter of a paperboard core is 181 to 310 mm, better results are achieved than before as to the increase of the chuck strength and production rate, considering all relevant aspects, when in a 1 m long paperboard core $L_{mp}$<4500 mm, preferably less than 3900 mm, and more preferably 3900 to 2000 mm, where $L_{mp}$ is the web edge length of the paperboard ply on the cylindrical surface representing the z-direction stress maximum within the wall of the paperboard core per 1 linear meter of the core.

The z-direction stress maximum in the wall of a finished paperboard core is located near the middle of the core wall, slightly towards the inner surface of the core. Although the cylindrical surface representing the z-direction stress maximum in the core wall is not exactly in the middle of the wall, the structural conditions and measure parameters are, however, practically almost identical. When a certain width has been selected for the paperboard ply to be subjected to the maximum stress, the surrounding plies, including the one in the middle of the wall, have almost the same theoretical width, as can be seen in Table 1. Table 1 shows a theoretical study on the ply widths of a 13×150 mm core, which has been constructed, according to prior art, of 25 plies, each ply being 0.53 mm thick. The ply widths are reported starting from interior ply 1, and the width of the exterior ply has been selected to be 155 mm. The denotation 13×150 mm refers to a core having the wall thickness of 13 mm and inside diameter of 150 mm. The following reference letters are used in the Table: t=order number of ply, number 1 referring to the interior ply; $sv_t$=wall thickness of ply t; $\varnothing_t$=outside diameter of ply t; $s_t$=width of ply+gap in ply t; $elength_t$=web edge length of ply t per 1 m of core. The stress maximum is located at about plies 10–11, where the average of the ply+gap is 153.837 mm. The middle of the core wall is situated at ply 13, where the ply+gap together make 154.066. As can be seen, the widths of the ply+gap in both the point of stress maximum and the middle of the core wall are almost equal. The web edge lengths of structural plies in a 1 m long core, calculated on the basis of theoretical studying, are about 3280.7 mm for ply t=10 and about 3300.347 mm for ply t=11, as can be read from Table 1. For purely practical reasons, every ply does not receive a width of its own, but only a few ply widths are selected for making up a core. For example, according to prior art, a 13×150 mm core is typically constructed of plies of two different widths, i.e., 154 mm and 155 mm. In this case, based on theoretical studying, the web edge length of the structural ply in the middle of the core wall is 3340 mm in a 1 m long core, as can be seen in Table 1. The difference between the web edge length of the structural ply in the stress maximum and the web edge length of the ply in the middle of the core wall is about 50 mm. A corresponding review could also be made with a commonly used core, which has the inside diameter of 76 mm.

The advantages of the present invention are emphasized when spiral paperboard cores are used with heavy roll weights and high winding and unwinding speeds. Paperboard cores constructed according to the present invention are used at reeling speeds which are at least about 200 m/min (3.3 m/s). Paperboard cores according to the present invention are advantageous at winding/unwinding speeds of 800–900 m/min and even higher, up to about 2500 m/min. The wider the paperboard ply is, the less it has of potential web edge per length unit, e.g., linear meter, where initial cracks could concentrate. The advantages of the present invention are emphasized also in connection with heavier roll weights and smaller cores, especially with cores having the inside diameter of 76 mm. The present invention provides a clear improvement in the runnability of cores used at the widest and fastest printing presses, i.e., where the rolls are the heaviest, and enables construction of such paper industry cores that meet the demands set by the new dimensions of paper rolls being designed. Printing presses being designed are to handle paper rolls of 1.35 m in diameter; estimates have been presented of paper rolls having a diameter of even up to 1.5 m. The roll widths of such printing presses will be as big as 3.6 m, whereby the weights of the paper rolls will increase considerably, to more than 6.5 tons, even to 8.5 tons. The present invention provides a worthwhile and advantageous arrangement for a core construction to meet these challenges.

A preferred arrangement according to the present invention is described in the following. A spiral paperboard core is fabricated by using, on the cylindrical surface representing the z-direction stress maximum in the wall of a finished paperboard core, and in the vicinity of said cylindrical surface, including tile paperboard ply in the middle of the core wall, ply widths which are, with the inside diameter of the paperboard core being 73 mm to 110 mm, at least 185 mm, preferably over 210 mm and more preferably over 230 mm, with the inside diameter of the paperboard core being 111 mm to 144 mm, at least 205 mm, preferably over 210 mm, and more preferably over 230 mm, with the inside diameter of the paperboard core being 145 mm to 180 mm, at least 210 mm, preferably over 250 mm, and more preferably 350 mm to 450 mm, and with the inside diameter of the paperboard core being 181 mm to 310 mm, at least 220 mm, preferably over 250 mm, and more preferably 350 mm to 500 mm, but at most the maximum ply width $L_{max}$ of each core of a certain diameter, where $L_{max}=(\pi)\times$(core diameter in the specific point).

Spiral paperboard cores of 3" and 6" which are commonly used, especially in the paper industry, are fabricated, according to the present invention, by winding paperboard plies spirally around a mandrel into a tube, whereby the following applies on the cylindrical surface representing the z-direction stress maximum in the wall of a finished paperboard core, and in the vicinity of said cylindrical surface, including the paperboard ply in the middle of the core wall, in a 1 m long paperboard core, which has the inside diameter of about 76 mm (3"):

$L_{mp}$<1550 mm, preferably less than 1400 mm, and more preferably less than 1300 mm, and which has the inside diameter of about 150 mm (6"):

$L_{mp}$<2200 mm, preferably 2000–1500 mm, and more preferably less than 1500 mm, where $L_{mp}$ is the web edge length of the paperboard ply on the cylindrical surface representing the z-direction stress maximum in the paperboard core wall per 1 linear meter of the core wall.

The following preferably also applies to these 3" and 6" cores: a spiral paperboard core is fabricated by using, on the cylindrical surface representing the z-direction stress maximum in the wall of a finished paperboard core, and in the vicinity of said cylindrical surface, including the paperboard ply in the middle of the core wall, ply widths which are with the inside diameter of the paperboard core being about 76 mm (3") at least 185 mm, preferably over 210 mm, and more preferably 210 mm to 240 mm, and with the inside diameter of the paperboard core being about 150 mm (6") at least 230 mm, preferably over 250 mm, and more preferably 250 to 450 mm, but at most the maximum ply width $L_{max}$ of each core of a certain diameter, where $L_{max}=(\pi)\times$(core diameter in the specific point).

Good results are obtained when, on the cylindrical surface representing the thickness direction stress maximum in the wall of a finished paperboard core, and in the vicinity of said cylindrical surface, including the paperboard ply in the middle of the core wall, ply widths are used which are at least 200 mm, preferably over 230 mm, but less than the maximum ply width $L_{max}$ of each core of a certain diameter, where $L_{max}=(\pi)\times$(core diameter in the specific point).

Paperboard cores for the paper industry are used at winding or unwinding speeds of at least about 200 m/min (3.3 m/s). Paperboard cores according to the present invention are advantageous at winding/unwinding speeds which are higher than about 300 m/min (5 m/s), typically about 800–900 m/min and even more, up to about 2500 m/min. For such reeling conditions, the arrangement of the present invention provides a paper industry core having an improved chuck strength, which core is thick-walled, the wall thickness H being 10 mm or more, and the inside diameter of over 70 mm. The arrangement of the present invention is advantageous also for improving the chuck strengths of paperboard cores which have similar dimensions and which call for high chuck strength.

In the arrangement of the present invention, in a finished paperboard core having the inside diameter of over 70 mm and wall thickness of over 10 mm, for improving the chuck strength, on the cylindrical surface representing the thickness direction stress maximum in the core wall, and in the vicinity of said cylindrical surface, including the ply in the middle of the core wall, ply widths are used which are preferably at least 200 mm, and more preferably over 230 mm, but less than the theoretical maximum ply width $L_{max}$ of each core of a certain diameter, where $L_{max}=(\pi)\times$(core diameter in the specific point). Thus, for example the theoretical maximum width of the middle ply of a 13×150 mm core is $L_{max}=\pi\times$(150 mm+1×13 mm), which is about 512.0 mm. Correspondingly, the theoretical maximum width of the middle ply of a 13×300 mm core is $L_{max}=\pi\times$(300 mm+1×13 mm), which is about 983.1 mm. And correspondingly, the theoretical maximum width of the middle ply of a 15×76 mm core is $L_{max}=\pi\times$(76 mm+1×15 mm), which is about 285.8 mm. Preferably, e.g., for reasons related to fabricating technique in practice, the middle ply width of a paperboard core is, however, 230 mm to 550 mm, depending on the core diameter.

The advantages of the present invention are naturally emphasized with wide plies. However, for reasons related to fabricating technique, it is advantageous, e.g., with 13×150 mm cores, to select such a ply width as facilitates fabrication with no great difficulties. The advantageousness of the present invention, i.e., an increase in the chuck strength, is pronounced with paper industry cores having small diameters, but the core production rate grows with all different sizes of paper industry cores.

For fabrication of a paper industry core having a certain inside diameter, it is preferred to use as wide paperboard plies as possible for the particular core dimension. The wider the ply width is, the more core meters will be produced per time unit; i.e., the higher the core production rate is; but on the other hand, the more complicated the fabricating process of the core itself is. For example, the spiral machine requires more space in the mill as the ply widths increase. Thus, it is not possible to fabricate paper industry cores as described above with presently used spiral machines, but a special spiral machine is required instead. Mere handling of wide plies, e.g., extending plies with a spiral machine becomes much more complicated as the width of the plies grows. Also controlling of the spiral machine becomes more difficult. Reasons related to practical core fabrication have an influence on how near the theoretical maximum width it is possible to grow the ply widths.

The most commonly used paper industry cores are the ones with the inside diameter of 76 mm (3"). Typically, one such core has plies the widths of which is about 140 to 155 mm (for example, the interior ply is 140 mm wide and the exterior ply is 155 mm, with a suitable width gradation therebetween). In the most typical prior art 13×150 mm (6") cores, plies are used which are about 150 to 155 mm wide. On the other hand, 13×150 mm cores are known, which have the widest ply width of about 190 mm. In the former cores constructed of 155 mm wide plies, the web edge length of the middle ply in a 1 m long core is about 3340 mm, as discussed above, and in the latter, constructed of 190 mm wide plies, the corresponding web edge length of the middle ply is about 2700 mm.

FIG. 2 illustrates the web edge length of the middle ply in a 1 m long core as a function of the middle ply width, for three typical paper industry cores: 15×76 mm, 13×150 mm, and 13×300 mm.

In accordance with the present invention, a suitable ply width, in view of practical core fabrication, e.g., for a 13×150 mm core is about 375 mm. Another preferred structural ply width for the same type of core is for example about 470 mm. Plies of these two widths as well as of the widths therebetween are still well controllable in special spiral machines. The web edge length of a 275 mm wide ply in a 1 m long 13×150 mm core is about 1415 mm and the web edge length of a 470 mm wide ply in a 1 m long core of the same size is about 1154 mm. Both arrangements in accordance with the present invention bring a clear improvement in shortening the web edge lengths of a ply, in comparison with typical prior art arrangements mentioned above, and so they also clearly decrease the number of potential points for initial cracks per linear meter of core.

When a spiral paperboard core is fabricated by winding narrow paperboard plies spirally around a mandrel into a tube, a gap is formed between two adjacent plies in the core structure. The gap widths of two adjacent plies of a paperboard core are of the order of 0.2 to 2.0 mm and even more, depending on the recipe and on the carefulness of the operator. The gaps between two plies are places where initial cracks concentrate when the core is loaded in the same way as in practice, in other words, dynamically. Dynamical loading may be simulated by a test, e.g., in accordance with EP patent 309 123. Especially, in stress endurance type loading, like the loading of a core, a crack starts advancing from an initial crack.

The more initial cracks there are in the core structure, the more opportunities there are for a crack breakage. Also, the more concentration places for initial cracks, i.e., the more gaps between spiral plies, the faster an advancing crack will reach another initial crack; for example, a crack initiating from the opposite edge of the same ply. In this case, the ply material will split altogether at that meeting point, and the core delaminates.

Figure 3:
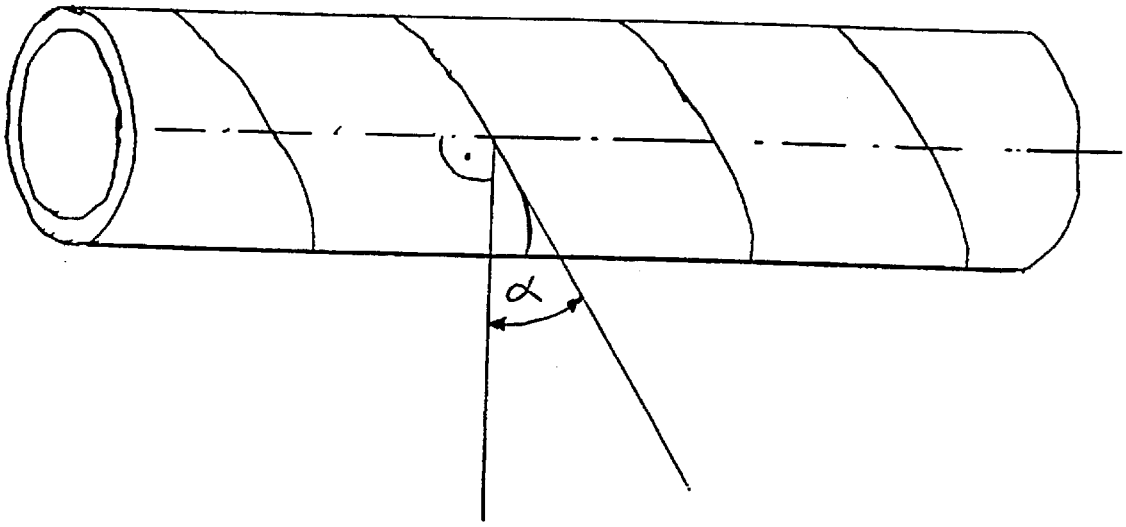
FIG. 3 shows the definition of the average winding angle $\alpha$.

The definition of an average winding angle $\alpha$ is presented in FIG. 3. The average winding angle refers to an acute angle $\alpha$ between the direction transverse to the core axis and the edge of the paperboard ply.

Figure 4:
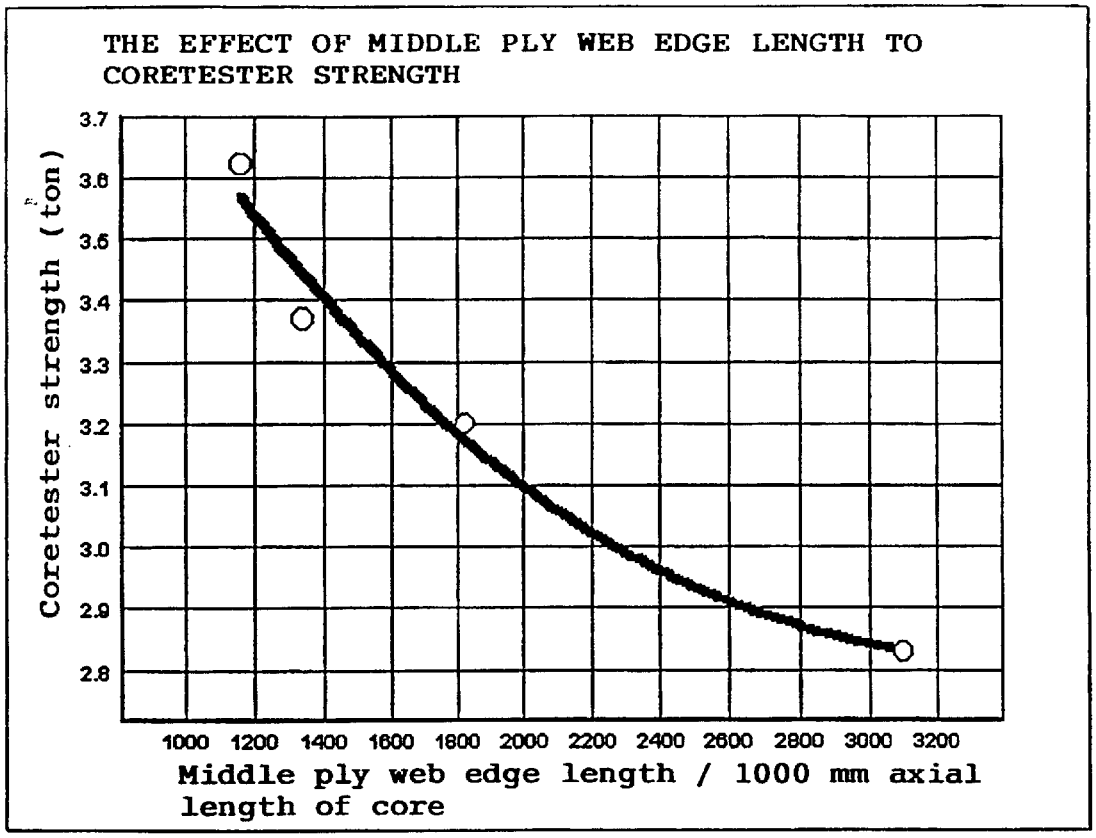
FIG. 4 shows the effect of the middle ply web edge length on the chuck strength.
Figure 5:
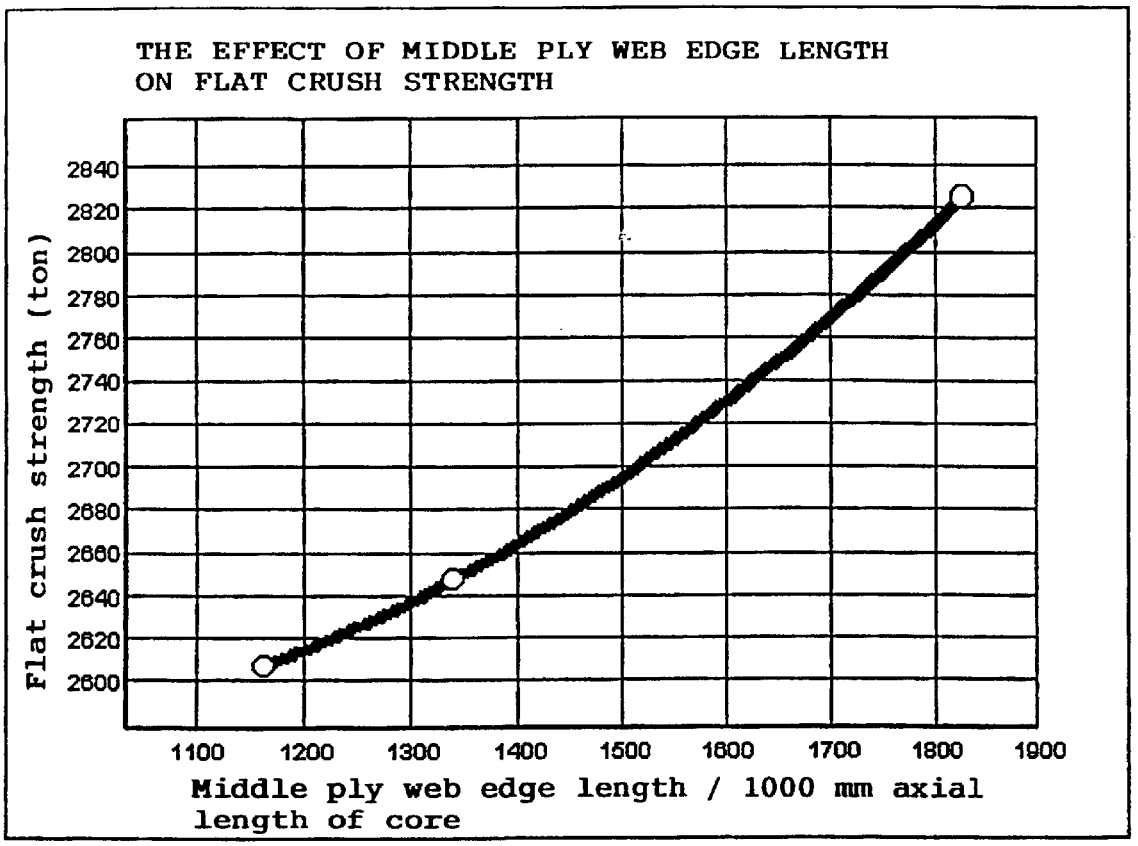
FIG. 5 shows the effect of the ply width of a paperboard core on the flat crush strength of the core, using the same design structure as in FIG. 4.

FIGS. 4 and 5 indicate the chuck strength and flat crush strength of test cores as a function of the middle ply length/1000 mm, using a model structure, which has an inside diameter of 50 mm. The chuck strength tests have been conducted by a method in accordance with EP patent 309 123 (the vertical axis "Coretester strength" denotes the chuck strength). The inside diameter of the paperboard cores was selected to be 50 mm in order to be able to vary within the required ply width range by using a conventional spiral machine. The same effect is valid for other diameters as well, such as cores which have the inside diameter of 76 mm and 150 mm, which cores are commonly used for big paper rolls.

FIG. 5 shows the influence of the middle ply length on the flat crush strength of the core, with the same core structure as in FIG. 4.

While the ply width is growing, whereby the average winding angle also grows, the flat crush strength of the core decreases, as shown by the example in FIG. 5. The decrease is different with different paperboards. With strongly orientated paperboards, such as, e.g., paperboards according to the invention of U.S. Pat. No. 2,194,275 (column 3, lines 4 to 14) the flat crush strength decreases more than, e.g., with modern, relatively square paperboards utilized, e.g., in the present invention. Such paperboards have been used in all the examples illustrating the present invention that have the orientation factor (the ratio of machine direction MD strength values to the cross machine direction CD strength values) of about 1.6 to 2.5. We are not using strongly orientated paperboards in the present invention, on the contrary.

The decrease of the flat crush strength as the ply width grows can be compensated, at least partly, by striving for as square orientation of a paperboard ply as possible. This is completely contrary to the teachings of U.S. Pat. No. 3,194,275. In the arrangement according to U.S. Pat. No. U.S. Pat. No. 3,194,275, it is stated on column 3, lines 4 to 14, that the highest possible orientation factor, in other words, as strong machine direction as possible in the paperboard, is striven for. This is because the problem presented in the U.S. Pat. No. 3,194,275 is tried to be solved by using a spiral core which is as convolute as possible. In this case, the orientation factor naturally has to be as high as possible. In the present invention, we are not using strongly orientated paperboards, on the contrary.

As discussed above, although flat crush strength is often used as a specified property of a core, a decrease thereof, especially in connection with high strength cores or other cores subject to heavy chuck loading, does not have such a harmful effect in practical conditions (=exacting dynamic loading) as was first estimated and as has been estimated earlier. U.S. Pat. No. 3,194,275 seeks to find a solution for problems related to compressive and beam strengths of a core (U.S. Pat. No. 3,194,275 column 1, lines 25 to 30 and 59 to 61), which indeed are essential when long, e.g., rug-type webs, are used. Such cores as described in U.S. Pat. No. 3,194,275 are typically used in handling of broad products, like e.g., fitted carpets, fabrics, plastics, or "scrims" used in excavation work for separating land masses from each other in road or yard bottoms. Such broad rug-type products do not support the core at all; on the contrary, they only strain it, especially as for beam strength. The applications of cores, according to U.S. Pat. No. 3,194,275, used as discussed above do not involve chuck loading stresses. These products are reeled at very low speeds, typically about 10 to 75 m/min. U.S. Pat. No. 3,194,275 suggests an approach in which a core constructed of plies in the length direction of the core, i.e., a convolutely wound tube, is replaced with a spirally wound tube, which, however, seeks to imitate a convolutely wound tube to the greatest possible extent. This is effected so that the material used is a paperboard ply which is orientated as much as possible in the machine direction (column 3, lines 4 to 14), and is then reeled into a spiral core so that it as much as possible resembles a convolutely wound tube. This is carried out by using the broadest possible average winding angle (as defined in the present invention, cf. FIG. 3. U.S. Pat. No. 3,194,275 defines the average winding angle so that it corresponds to the complement of the average winding angle of the present invention).

The present invention is also based on the discovery that because of dynamic loading present in real loading of paper industry cores, the most essential and the most important aspect in estimating the strength and expediency of such a paperboard core and other paperboard cores which are subject to heavy chuck loading, is not the flat crush strength but the chuck strength of the core. The flat crush strength of a core is usable to suggestively indicate chuck strength provided that the other factors, i.e., wall thickness, inside diameter, and the ply widths used are constant, i.e., the core structure is constant, and only the ply material is changing. The flat crush strength is, however, usually used as the main criterion when describing the expediency of a paperboard core, and it is roughly applicable to describing it, too, if the above-identified limitations are taken into account. This comparison, i.e, a description of a dynamically measurable paperboard core property by using a statically measurable property, is possible; but it is possible only if the core structure and other parameters identified above remain unchanged and only the raw material changes. However, the result is only suggestive, because a statically measured property can never directly tell what happens in dynamic stress conditions like the core stress conditions are, in practice.

The arrangement according to the present invention provides an improvement in the strength of all cores for which the chuck strength is an important criterion of expediency. When a paperboard ply is widened, the average winding angle grows because the core diameter remains unchanged. When the paperboard ply is wider than before, the amount of gaps, i.e., potential points of initial cracks per length unit in a linear meter of finished core is smaller. Thereby, the capacity, chuck strength, and load-bearing capacity will increase. This makes it possible to reduce core manufacturing costs. Earlier, the weakening effect of gaps on a core had to be compensated by stronger paperboard than what is needed for the arrangement of the present invention. On the other hand, an economic advantage is obtained also by a higher core production rate per time unit.

Preferably ⅕ or more of the wall thickness of the paperboard core is comprised of paperboard plies, which have preferably been fabricated by using a press drying method, for example, a so-called Condebelt method.

The invention has been described above by what is considered to be preferred embodiments thereof. Naturally, this is by no means intended to limit the present invention and, as is evident to a person skilled in the art, many alternative and optional dimensions and modifications are feasible within the inventive scope defined by the accompanying claims.

What is claimed is:

1. A method of fabricating paperboard cores for use in winding or unwinding at speeds of at least 200 m/min., said method comprising:

a) winding a plurality of paperboard plies spirally around a mandrel into a tube to produce a paperboard core having a cylindrical surface and inside diameter, and a wall thickness of 10 mm or more; and b) wherein a) is practiced to produce: (i) a core having an inside diameter of 73–110 mm and an $L_{mp}$ less than 1550 mm; (ii) a core having an inside diameter of 111–144 mm and an $L_{mp}$ less than 1900 mm; (iii) a core having an inside diameter of 145–180 mm and an $L_{mp}$ less than 2450 mm; or (iv) a core having an inside diameter of 181–310 mm and an $L_{mp}$ less than 4500; wherein $L_{mp}$ is the web edge length of a paperboard ply on the cylindrical surface of the core representing the maximum z-direction stress in the paperboard core wall per one linear meter of the paperboard core.

2. A method as recited in claim 1 wherein a) and b) are practiced to produce a core within an inside diameter of between 73–110 mm, and an $L_{mp}$ less than 1450 mm.

3. A method as recited in claim 2 wherein a) and b) are practiced to produce a core with an inside diameter of between 145–180 mm, and an $L_{mp}$ less than 2200 mm.

4. A method as recited in claim 2 wherein a) and b) are practiced to produce a core with an inside diameter of between 145–180 mm, and an $L_{mp}$ less than 1500 mm.

5. A method as recited in claim 1 wherein a) and b) are practiced to produce a core within an inside diameter of between 73–110 mm, and an $L_{mp}$ less than 1300 mm.

6. A method as recited in claim 1 wherein a) and b) are practiced to produce a core having an inside diameter of between 111–144 mm, and an $L_{mp}$ less than 1650 mm.

7. A method as recited in claim 1 wherein a) and b) are practiced to produce a core having an inside diameter of between 111–144 mm, and an $L_{mp}$ less than 1500 mm.

8. A method as recited in claim 1 wherein a) and b) are practiced to produce a core having an inside diameter of between 180–310 mm and an $L_{mp}$ of less than 3900 mm.

9. A method as recited in claim 1 wherein a) and b) are practiced to produce a core having an inside diameter of between 180–310 mm and an $L_{mp}$ of less than 2000 mm.

10. A method as recited in claim 1 wherein a) is practiced utilizing plies having a maximum ply width $L_{max}$ equal to ($\pi$)×the core diameter.

11. A method as recited in claim 10 wherein a) is practiced using ply widths: i) for a core having an inside diameter of 73–110 mm, at least 185 mm; ii) a core having an inside diameter of 111–144 mm, ply widths of at least 205 mm; iii) for a core having an inside diameter between 140–180 mm, a ply width of at least 210 mm; and iv) for a core having a diameter of 181–300 mm, a ply width of at least 220 mm.

12. A method as recited in claim 10 wherein a) is practiced using ply widths: i) for a core having an inside diameter of 73–110 mm, at least 220 mm; ii) a core having an inside diameter of 111–144 mm, ply widths of at least 210 mm; iii) for a core having an inside diameter between 140–180 mm, a ply width of at least 250 mm; and iv) for a core having a diameter of 181–300 mm, a ply width of at least 250 mm.

13. A method as recited in claim 10 wherein a) is practiced using ply widths: i) for a core having an inside diameter of 73–110 mm, at least 230 mm; ii) a core having an inside diameter of 111–144 mm, ply widths of at least 230 mm; iii) for a core having an inside diameter between 140–180 mm, a ply width of about 350–400 mm; and iv) for a core having a diameter of 181–300 mm, a ply width of about 350–500 mm.

14. A method as recited in claim 1 wherein a) and b) are practiced to produce a paperboard core having an inside diameter of about 76 mm and wherein $L_{mp}$ is less than 1300 mm, and using plies in the practice of a) which are between about 210–240 mm wide; or to produce a paperboard core having an inside diameter of about 150 mm, wherein $L_{mp}$ is less than 1500 mm, and a) is practiced utilizing plies having a width between 250–450 mm.

15. A method as recited in claim 1 further comprising producing a paperboard core wherein at least one-fifth of the wall thickness of the paperboard core is comprised of paperboard plies having been fabricated utilizing the Condebelt method.

16. A method of using a paperboard core made according to claim 1, comprising c) winding or unwinding a web or strand onto or off of said core by mounting said core with chucks, and rotating the chucks at a speed of at least about 200 m/min.

17. A method as recited in claim 16 wherein c) is practiced by winding or unwinding a paper web on said core having a weight, at the start of unwinding or after the completion of winding, of at least 8.5 tons.

18. A method of using a paperboard core made according to claim 14, comprising c) winding or unwinding a web or strand onto or off of said core by mounting said core with chucks, and rotating the chucks at a speed of at least about 200 m/min.

19. A paperboard core comprising:

a plurality of paperboard plies defining a tube having a cylindrical surface and inside diameter, and a wall thickness of 10 mm or more; and wherein when said core has an inside diameter of 73–110 mm it has an $L_{mp}$ less than 1550 mm; and when said core has an inside diameter of 111–144 mm it has an $L_{mp}$ less than 1900 mm, when said core has an inside diameter of 145–180 mm it has an $L_{mp}$ less than 2450 mm; and when said core has an inside diameter of 181–310 mm it has an $L_{mp}$ less than 4500 mm; wherein $L_{mp}$ is the web edge length of a paperboard ply on said cylindrical surface of said core representing the maximum z-direction stress in the paperboard core wall per one linear meter of the paperboard core.

20. A paperboard core as recited in claim 19 wherein the paperboard plies making up the tube have a maximum ply width $L_{max}$ equal to ($\pi$)×the core diameter, and a minimum ply thickness of: when said core has an inside diameter of 73–110 mm, at least 230 mm; when said core has an inside diameter of 111–144 mm, at least 230 when said core has an inside diameter of 145–180 mm, 350 mm; and when said core has an inside diameter of 181–310 mm, at least 350 mm.

21. A paperboard core as recited in claim 19 comprising a web of paper wound thereon and having a weight of at least 8.5 tons.

22. A paperboard core as recited in claim 19 wherein at least one-fifth of the wall thickness of the paperboard core is composed of paperboard plies fabricated by using the Condebelt.

23. A paperboard core as recited in claim 19 wherein for a core having an inside diameter or 73–110 mm it has an $L_{mp}$ less than 1300 mm; for a core having an inside diameter of 111–140 mm, it has an $M_{mp}$ less than 1500 mm; for a core having an inside diameter of 145–180 mm it has an $L_{mp}$ of less than 1500 mm; and for a core having an inside diameter of between 181–310 mm it has an $L_{mp}$ less than 2000 mm.

* * * * *